United States Patent [19]

Hetherington

[11] 4,215,264

[45] Jul. 29, 1980

[54] TELESCOPING HAIR CURLER

[75] Inventor: Michael W. Hetherington, Markham, Canada

[73] Assignee: Appliance Design Probe Inc., Scarborough, Canada

[21] Appl. No.: 934,709

[22] Filed: Aug. 21, 1978

[51] Int. Cl.[2] ..... A45D 2/24; A45D 1/04; H05B 3/06; H01R 11/02

[52] U.S. Cl. ..... 219/225; 132/34 R; 132/37 A; 219/533; 339/8 R; 339/58

[58] Field of Search ..... 132/37 R, 37 A, 39, 132/40, 33 R, 33 D, 33 F, 33 G, 34 R, 34 A, 34 B, 34 C, 76.2; 339/8 R, 8 P, 6 R, 9 RY, 58; 219/222, 225, 533

[56] References Cited

U.S. PATENT DOCUMENTS

| | | | |
|---|---|---|---|
| 3,934,114 | 1/1976 | Godd | 219/225 X |
| 3,963,291 | 6/1976 | Maloof | 339/8 P |
| 4,003,616 | 1/1977 | Springer | 339/8R |
| 4,034,201 | 7/1977 | Walker et al. | 219/225 X |
| 4,040,696 | 8/1977 | Wada et al. | 339/8 R |
| 4,100,397 | 7/1978 | Kunimi | 219/225 X |
| 4,101,757 | 7/1978 | Van Dyck et al. | 219/225 |

FOREIGN PATENT DOCUMENTS

| | | | |
|---|---|---|---|
| 1375768 | 11/1974 | United Kingdom | 219/225 |

*Primary Examiner*—Stuart S. Levy
*Attorney, Agent, or Firm*—Sim & McBurney

[57] ABSTRACT

There is provided a telescoping hand-held hair curler in which a heatable barrel slides longitudinally with respect to a hollow handle. The electrical wires carrying power to heat the barrel enter the rearward end of the handle and connect to a swivel coupling which reciprocates within the handle. The barrel extends forwardly from the swivel coupling and out through the other end of the handle. The construction avoids having loose wires running between a stationary swivel coupling and a moving barrel.

5 Claims, 3 Drawing Figures

TELESCOPING HAIR CURLER

This invention relates generally to electrically powered beauty aids, and has to do particularly with a hand-held hair curler.

Hand-held hair curlers have recently become popular. They consist generally of a handle, a barrel projecting from the handle and including internal heating elements, and a trigger-operated clamp pivoted toward the handle end of the barrel, so that the clamp can swing between a position in which it is biased against the barrel and a position in which it is angled away from the barrel so that the user can wrap the hair around the barrel. When the hair has been so wrapped, the clamp is allowed to return toward the barrel, usually under an inherent biasing mechanism, to clamp the hair in place during the heating and setting operation.

Because the user typically will twirl the implement in order to "wind" the hair on the barrel, a difficulty can arise in connection with the electrical wire. If the electrical wire is fixed at its location of attachment with respect to the handle, and no provision is made for swivelling, it is possible to tangle the wire badly through the twirling of the device in use, and this can result in damage to the wire, short-circuits, and so forth.

Most commercially available hand-held hair curlers include a swivel connection between the wire and the main handle housing, which allows the user to rotate the housing while the wire remains stationary. This avoids excessive twisting of the wire.

The hair curler just described is the conventional hair curler which usually measures about a foot in length, and which has no capability of being shortened. However, there is a need for a device which can be collapsed telescopically to a smaller dimension, particularly for travelling purposes.

Introducing the telescoping capability into the hand-held hair curler, however, raises a problem relating to the electrical connections. The obvious construction, in which the swivel mounting remains at one end of the handle or housing portion and in which the barrel reciprocates internally of the handle, involves a problem relating to the wires connecting the swivel coupling with the reciprocating near end of the barrel. These wires may become worn, twisted or caught within the apparatus during the repeated reciprocating motion as the device is placed in use and then collapsed for storage or travel. This construction has been utilized in conventional telescoping hair curlers, and the problem relating to the danger from the bending link wires is one which requires a solution.

An aspect of the present invention is to provide a telescoping hand-held hair curler whose construction is such that the problem relating to bending link wires does not arise.

Another difficulty arising with the known telescoping construction described just above, in which the connecting wires remain at all times within the handle, has to do with the use of steam. A popular feature of hair curlers is that of being able to "steam" the hair while it is wrapped on the barrel, this being usually accomplished by providing a small container of water supported longitudinally off the end of the "hot" barrel. The container has a felt wick which remains at all times moist and which extends toward the heating element within the barrel. The container is spring-biased away from the barrel so that, normally, the felt wick remains out of contact with the barrel. However, inward pressure by the finger against the container will bring the moist felt wick into contact with the hot heating element and steam will result.

If such steam capability were provided in a telescoping construction having connecting wires which remain at all times within the barrel, then the inadvertent use of the steam capability while the element was hot and the barrel inside the handle (closed position) would cause steam to enter the interior or the handle, coming into contact with the wires. The standards applicable to electrical instruments of this type are framed in such a way that any such contact of steam or water with the internal electrical components must be avoided and therefore it would not be possible, with the construction involving loose connecting wires, to provide a steam capability.

A further aspect of the present invention is to provide a telescoping hand-held hair curler which is such that a steaming capability may be safely provided.

Accordingly, this invention provides a hand-held hair curler comprising:

an elongated housing defining an internal elongated slide chamber, an electrical swivel coupling including a non-rotary portion adapted to reciprocate in said slide chamber but being restrained against rotation with respect to said housing, and a swivelling portion adapted to rotate with respect to said non-rotary portion, but being restrained against longitudinal movement with respect to said non-rotary portion, said swivelling portion including an electrical wire, whereby the wire can swivel with respect to the housing and can reciprocate along said housing as said non-rotary portion reciprocates, and hair-heating means connected to said non-rotary portion and projecting therefrom remote from said wire, the hair-heating means including a barrel projecting through an end of the housing.

One embodiment of this invention is illustrated in the accompanying drawings, in which like numerals denote like parts throughout the several views, and in which.

Figure 1:
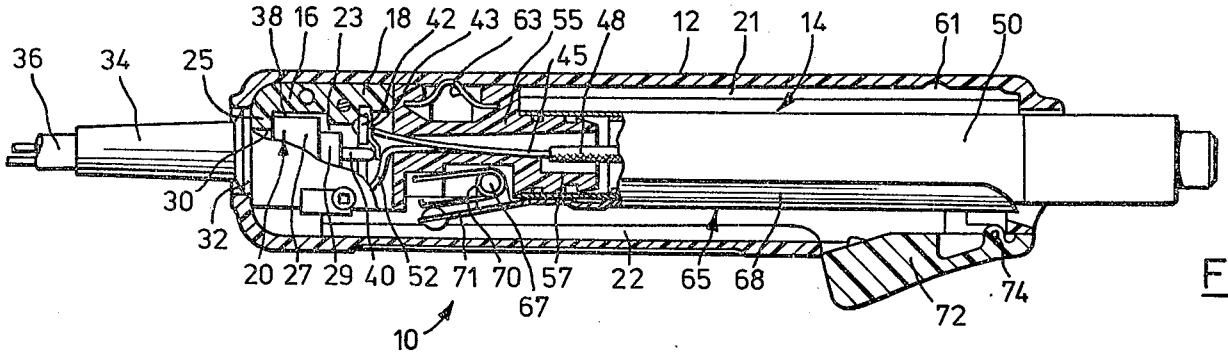
FIG. 1 is a longitudinal sectional view through a hair curler constructed according to this invention, in its collapsed condition.

Attention is first directed to FIG. 1, in which a hair curler 10 is seen to include an elongated housing 12 defining an internal elongated slide chamber 14.

An electrical swivel coupling generally denoted by the numeral 16 is provided within the slide chamber and is adapted to reciprocate along the slide chamber. The electrical swivel coupling includes a non-rotary portion 18 which is the actual part adapted to reciprocate along the slide chamber 14, and a swivelling portion 20 is adapted to rotate with respect to the non-rotary portion 18. The non-rotary portion 18, although it is adapted to reciprocate longitudinally of the slide chamber 14, is restrained against swivelling or rotational movement with respect to the housing 12. This restraint arises due to the non-circular section of the slide chamber 14. The section of the slide chamber 14 is in the main circular, but has two antipodal projections 21 and 22 as seen in FIG. 1, which constitute upwardly and downwardly projecting grooves running longitudinally of the otherwise circular slide chamber 14. The non-rotary portion 18 of the swivel coupling 16 has a complementary cross-section which is receivable within the non-circular section of the slide chamber, and thus has projecting portions adapted to be received in the grooves 20 and 21.

The swivelling portion 20 is restrained against longitudinal motion with respect to the non-rotary portion 18 by virtue of being "captured" within a radially symmetrical chamber 23 defined by the latter. The non-rotary portion includes an inwardly extending lip 25, against which bears an enlarged cylindrical part 27 of the swivelling portion 20. Integrally formed with the cylindrical portion 27 is a smaller cylindrical portion 29, a neck portion 30, a flange portion 32 and a transition portion 34. The wire 36 projects leftwardly from the transition portion 34. The outer surface of the cylindrical portion 27 is covered with a layer 38 of conductive metal, to which one of the filaments of the wire 36 is electrically connected. The other filament of the wire 36 is electrically connected to a pin 40 which is coaxial with both of the cylindrical portions 27 and 29, and which projects through an opening in a plate 42 which is secured with respect to the non-rotary portion 18 of the swivel coupling 16. A leftwardly biased terminal 43 is electrically connected to a wire 45 and bears leftwardly against the pin 40. The wire 45 is connected to a heating element 48 internally of a metal barrel 50. The heating element 48 is connected to a second wire 52 which passes to a contact (not seen in the figures) adapted to bear constantly against the layer 38 of metal. Thus, the two filaments of wire 36 are connected to the wires 45 and 52 in a way that allows the wire 36 to rotate without breaking the contact.

A mounting portion 55 is secured to the non-rotary portion 18 of the swivel coupling 16, and includes a rightwardly projecting nose portion 57 adapted to be received snugly within the metal barrel 50. The nose portion 57 has annular galleries or recesses to increase its flexibility.

Figure 2:
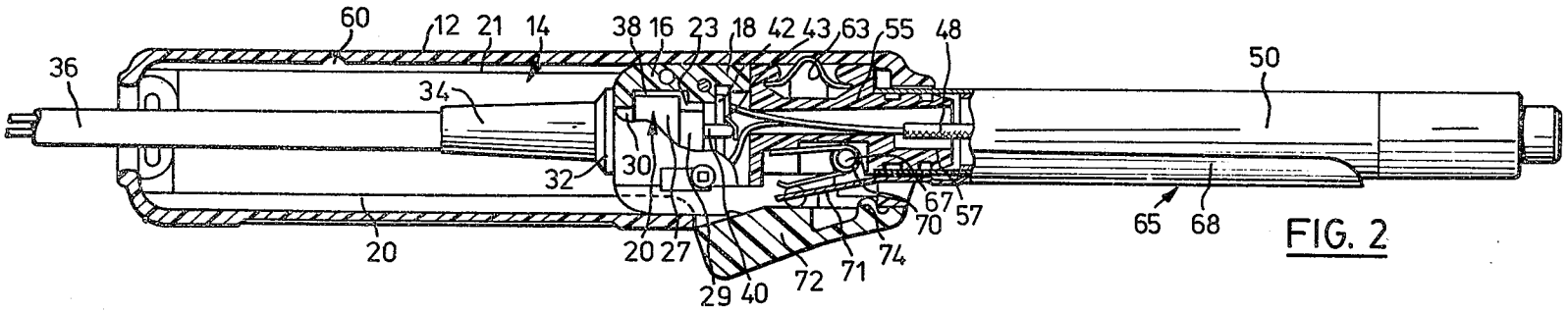
FIG. 2 is a longitudinal sectional view of the hair curler of this invention, in its extended position.

Within the groove 21 the elongated housing 12 is provided with a first recess 60 and a second recess 61. The mounting portion 55 supports a resilient curved spring element 63 which defines a central rounded portion adapted to be received removably within either of the recesses 60 and 61, thus locking the internal components in one of two longitudinal positions with respect to the housing 12. FIG. 1 shows the inner or retracted position, while FIG. 2 shows the outer or extended position.

A clamp 65 is pivoted about a pin 67 passing through the "eye" of a spring 70, and has a rightwardly extending free end 68 which is adapted to lie along the barrel 50, but which can pivot or swing away from the barrel about the pivot point 67.

The clamp 65 is biased against the barrel 50 by the spring 70, which is of known type and which urges outwardly against an inner end 71 of the clamp 65, the inner end being on the other side of the pivot 67 from the free end 68.

The housing includes a depressible trigger 72 pivoted at 74, and capable of manual depression. The depression in FIG. 1 would involve the clockwise rotation of the depressible trigger, so that its major portion would move upwardly as pictured in the figure.

The trigger 72 is adapted to urge inwardly against the inner end 71 of the clamp 65, when the hair curler is in the position shown in FIG. 2, whereby the clamp 65 can swing outwardly away from the barrel 50.

Figure 3:
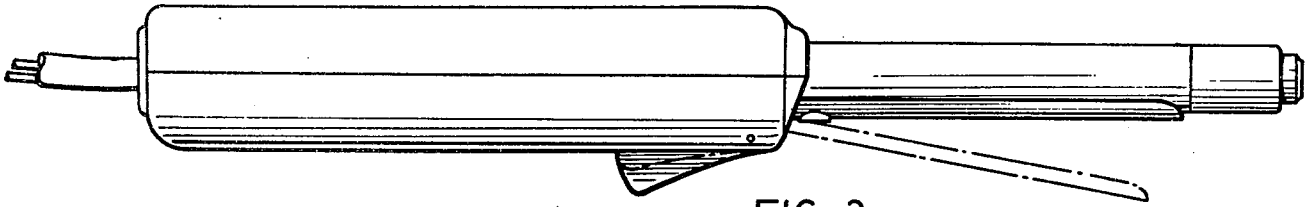
FIG. 3 is an elevational view of the hair curler of this invention, to a slightly smaller scale.

FIG. 3 shows the hair curler in its extended position, in elevation.

What I claim is:

1. A hand-held hair curler comprising:

an elongated housing defining an internal elongated slide chamber with a barrel opening in one end and a wire opening in the other end, an electrical swivel coupling including a non-rotary portion adapted to reciprocate in said slide chamber but being restrained against rotation with respect to said housing, and a swivelling portion adapted to rotate with respect to said non-rotary portion, but being restrained against longitudinal movement with respect to said non-rotary portion, said swivelling portion including an electrical wire, whereby the wire can swivel with respect to the housing and can reciprocate along said housing as said non-rotary portion reciprocates, the wire extending out through said wire opening and being slidable therein, and hair-heating means connected to said non-rotary portion and projecting therefrom remote from said wire, the hair-heating means including a barrel which can project through said barrel opening.

2. The invention claimed in claim 1, in which the elongated slide chamber is of constant non-circular cross-section, the non-rotary portion being complementary to said cross-section.

3. The invention claimed in claim 2, in which the chamber cross-section is in the main circular but has two antipodal projections.

4. The invention claimed in claim 1, in which the hair-heating means includes a swivel clamp pivoted with respect to the barrel close to the swivel coupling and having a free end lying along the barrel, and means for biasing the clamp against the barrel.

5. The invention claimed in claim 4, in which a depressable trigger is provided on said housing adjacent the end through which said barrel projects, the trigger being positioned so as, when depressed, to urge inwardly against a part of said clamp adjacent the pivot therefor, thereby to move the said free end away from said barrel.

* * * * *